United States Patent [19]

Muroi et al.

[11] Patent Number: 4,649,843

[45] Date of Patent: Mar. 17, 1987

[54] SEWING MACHINE

[75] Inventors: Shiyouzi Muroi; Katsuhiko Taguchi, both of Tokyo, Japan

[73] Assignee: Tokyo Juki Industrial Co., Ltd, Chofu, Japan

[21] Appl. No.: 551,017

[22] Filed: Nov. 14, 1983

[51] Int. Cl.[4] ..... D05B 87/02

[52] U.S. Cl. ..... 112/270; 112/225

[58] Field of Search ..... 112/197, 199, 224, 225, 112/270

[56] References Cited

U.S. PATENT DOCUMENTS

| | | | |
|---|---|---|---|
| 1,801,166 | 4/1931 | Maier | 112/225 |
| 2,655,886 | 10/1953 | Ingwer | 112/225 |
| 3,308,778 | 3/1967 | Nakajima | 112/225 |
| 4,300,463 | 11/1981 | Morimoto | 112/225 |

FOREIGN PATENT DOCUMENTS

| | | | |
|---|---|---|---|
| 1184085 | 3/1970 | United Kingdom | 112/225 |

*Primary Examiner*—Wm. Carter Reynolds

*Attorney, Agent, or Firm*—Tarolli, Sundheim & Covell

[57] ABSTRACT

A sewing machine is disclosed herein. The sewing machine comprises a looper rockably supported on the frame of the machine below the throat plate for rocking movement in response to the rotation of the machine shaft and having first and second thread holes, a thread transfer mechanism adapted to move the leading end of a looper thread to a position facing the second thread hole after the leading end of the thread has passed through the first thread hole and a threading device adapted to pass the leading end of the looper thread through the second thread hole.

2 Claims, 18 Drawing Figures

SEWING MACHINE

BACKGROUND OF THE INVENTION

This invention relates to a sewing machine and more particularly, to a threading device for the looper in the sewing machine.

The conventional looper mechanisms for an overlock sewing machine and the like, for example, have been generally provided in a relatively limited space below the bed of the sewing machine where the feed mechanism and cloth cutting mechanism are disposed and thus, it has been difficult to access to a position adjacent the pointed end of the looper of the looper mechanism. Therefore, the conventional looper mechanisms have the disadvantages that unskilled operators have spent a long time for passing the looper thread through the thread holes in the looper and particularly, the thread hole at the leading end of the looper.

SUMMARY OF THE INVENTION

Therefore, the present invention is to eliminate the disadvantages inherent in the conventional threading devices and provide an improved threading device for the looper in a sewing machine which enables unskilled workers to simply and easily pass the looper thread through the thread holes in the looper.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

BRIEF DESCRIPTION OF THE DRAWINGS

FIGS. 9 through 18 are views of a second embodiment of the threading device for the looper in a sewing machine constructed in accordance with the present invention in which:

FIGS. 9, 11 and 14 are fragmentary perspective views showing the second embodiment of threading device with the looper removed therefrom;

FIG. 10 is a cross-sectional view on an enlarged scale taken along the line X—X of FIG. 9;

FIGS. 13, 14, 16, 17 and 18 are views on an enlarged scale showing the passage of the looper thread through the thread holes in the looper; and FIG. 15 is a cross-sectional view on an enlarged scale of the looper thread threader rod for use in the second embodiment of the threading device for the looper in a sewing machine.

PREFERRED EMBODIMENTS OF THE INVENTION

Figure 1:
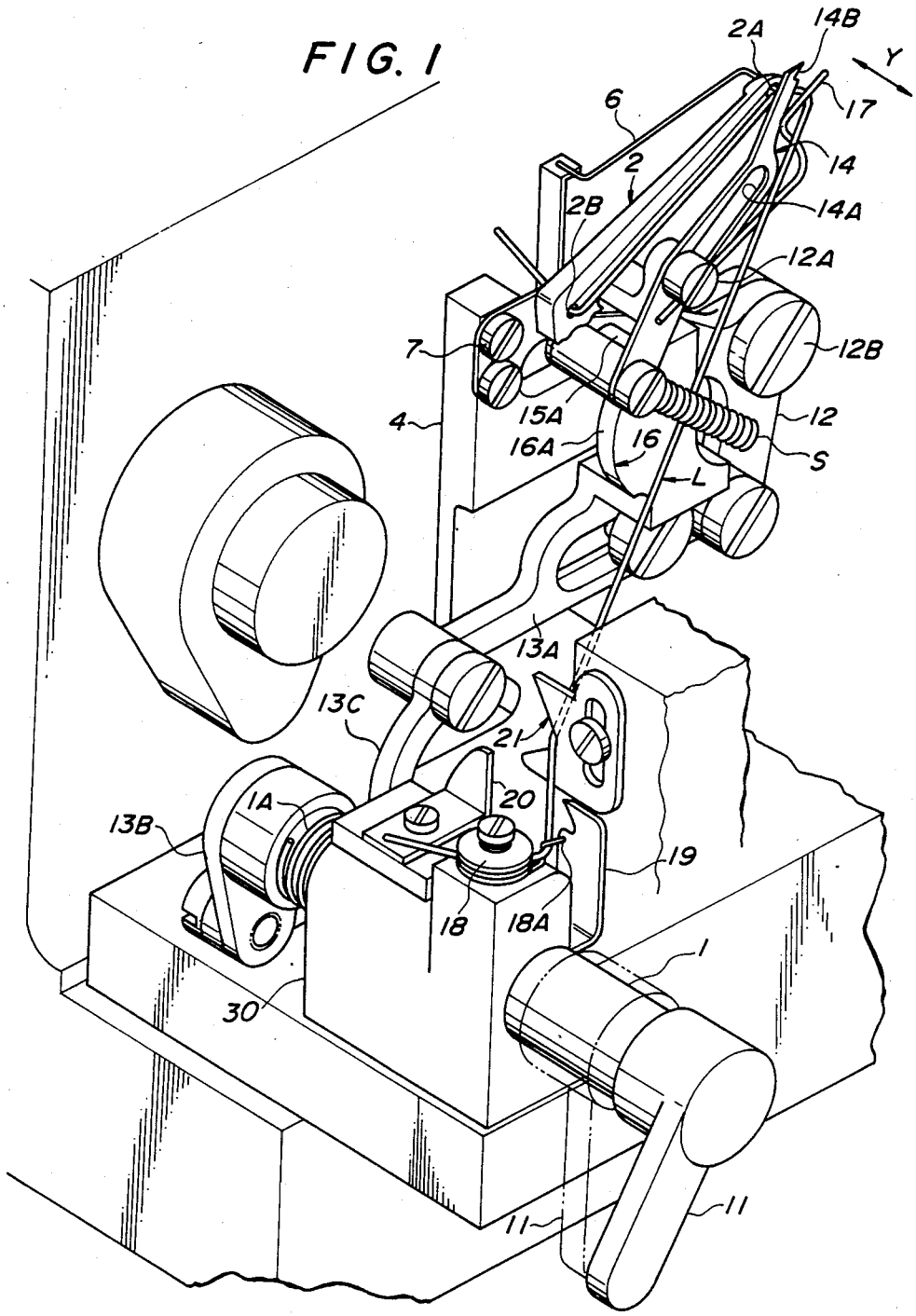
FIG. 1 is a perspective view of a first embodiment of the threading device for the looper in a sewing machine constructed in accordance with the principle of the present invention.

The present invention will be now described referring to the accompanying drawings and more particularly, to FIGS. 1 through 8 in which the first embodiment of the threading device for the looper in an overlock sewing machine is shown. In the perspective view of FIG. 1, the threading device for the looper is shown as being mounted on the overlock sewing machine below the bed of the machine. In this Figure, reference numeral 1 denotes a hollow shaft supported on the machine frame 3 of the sewing machine for slidable movement in the opposite arrow directions Y parallel to the center axis of first and second thread holes 2B, 2A formed at the leading and rear ends of the conventional looper 2 which is conventionally mounted on the sewing machine frame and the shaft 1 is normally biased to its retracted position by the biasing force of a spring 1A anchored at the opposite ends thereof to the machine frame and shaft, respectively. The shaft 1 is hollow and is smoothly inserted into a hole provided in a frame 3. An operation shaft 10 is smoothly inserted into the hollow shaft 1. An operation 11 is fixed to one end of the shaft 10. A linkage 13 is fixed to the other end of the shaft 10. A compressive spring 1A is provided between the frame and the linkage. A vertically movable plate 4 is secured at the lower end to the movable shaft 1 in parallel to the longitudinal direction of the looper 2 (FIG. 3) for movement in the arrow directions Y as the movable shaft 1 moves in the same directions.

A crochet needle 6 is secured at the base end to the upper end of the movable plate 4 and has an upwardly bent hook 6A at the leading or free end (FIG. 5) and thus, the crochet needle serves as a threader means. The crochet needle 6 is so arranged that when the movable shaft 1 moves in one of the arrow directions Y the hook 6A advances into the second thread hole 2A in the looper 2 to catch the looper thread L positioned in front of the thread hole 2A and when the shaft 1 moves in the opposite arrow direction Y the hook 6A withdraws from the thread hole 2A to pass the looper thread L through the thread hole 2A. Although the crochet needle 6 is shown as being secured to the movable plate 4 by screws 7 in the embodiment of FIG. 1, the crochet needle 6 may be supported at the base end on the machine frame 30 for slidable movement in the arrow directions Y as shown in FIG. 2. In the arrangement shown in FIG. 2, a transverse rod 8 is secured at one end to an intermediate point between the opposite ends of the crochet needle 6 and received at the other end in a hole 9A formed at one or the upper end of an anchor rod 9 which is in turn secured at the base end to the movable plate 4. As the movable plate 4 moves in one and the other directions, secured anchor rod 9 causes transverse rod 8 to move in parallel. Movement of transverse rod 8 in turn causes parallel movement of crochet needle 6 and the hook 6A of the crochet needle 6 advances into and withdraws from the thread hole 2A in the looper 2.

Figure 3:
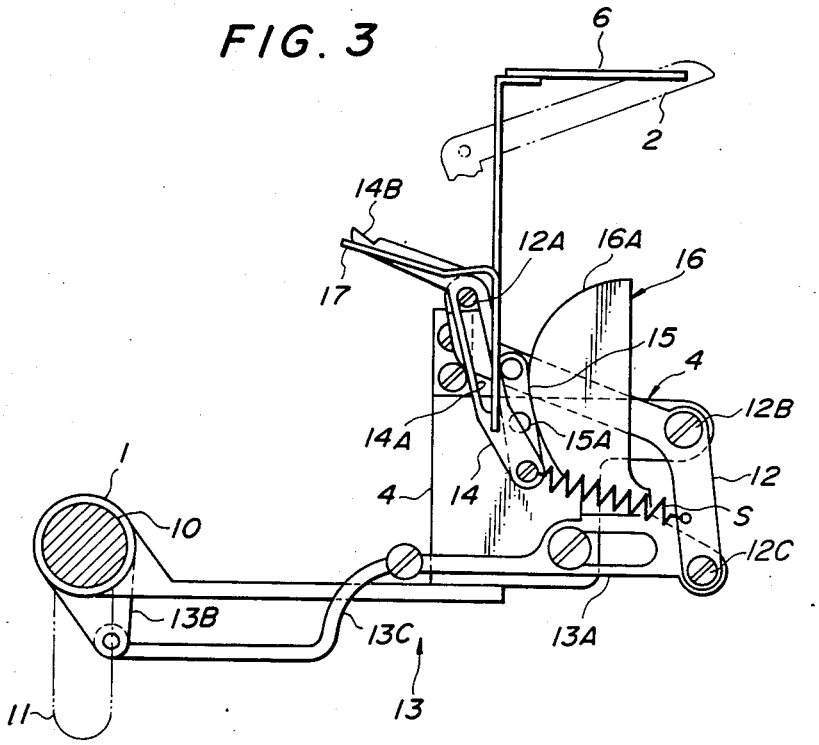
FIGS. 3 and 4 are views showing the operation of the threading device as shown in FIG. 1 in different stages thereof.
Figure 4:
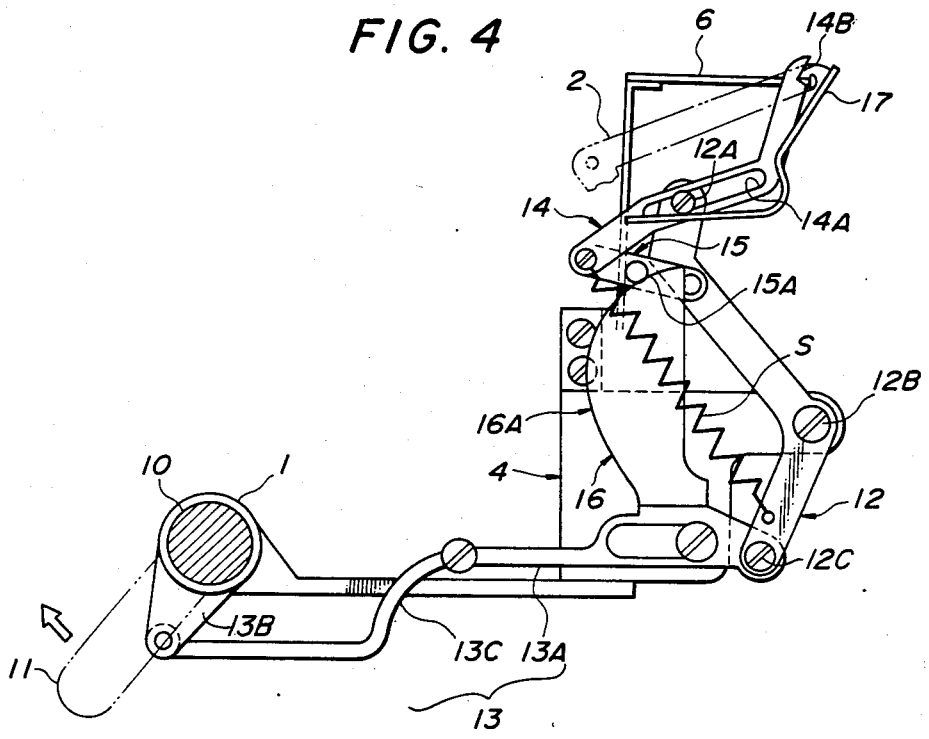

An operation shaft 10 is supported within the hollow interior of the reciprocally movable shaft 1 for rotation about the common axis of the shafts 1 and 10 and secured at the base end to one end of an operation lever 11 so that as the operation lever 11 is rotated in the clockwise and counter-clockwise directions, the shaft 10 is rotated in the same directions as the lever (FIGS. 3 and 4).

A guide arm 12 is rockably supported on the movable plate 4 and has a pin 12C secured at one or the lower end to a linkage 13 which connects between the operation shaft 10 and guide arm 12 so that the guide arm 12 can rotate about a pin 12B which connects between the movable plate 4 and guide arm 12. The linkage 13 comprises a first link 13A rotatably supported at one end on the other or lower end of the guide arm 12, a crank arm 13B secured at one end to the operation shaft 10 and a second link 13C rotatably supported at one end on the other end of the first link and integrally connected at the other end to the crank arm. Thus, clockwise or counterclockwise movement of operation shaft 10 that is interior of shaft 1 moves crank arm 13B which in turn moves second link 13C, which in turn moves first link 13A, which moves guide arm 12 rotating it about pin 12B. A thread hanging arm 14 having a guide slot 14A in an intermediate point between the opposite ends for receiving the pin 12A on the guide arm 12 and a thread hanging portion 14B at one or the upper end is rotatably supported at the other end on one end of a connector rod 15 which is in turn rotatably supported at the other end on the guide arm 12 between the pins 12A and 12B. The thread hanging arm 14 serves as a thread transfer means and the hanging portion 14B has a cut which opens in the direction intersecting the movement direction of the crochet needle 6.

Figure 7:
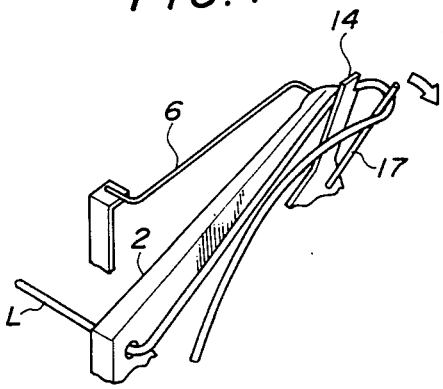

A cam 16 is secured at one or the lower end to the first link 13A of the linkage 13 which moves as the operation shaft 10 rotates and has a cam face 16A adapted to contact a pin 15A secured to the connector rod 15 to rotate the connector rod whereby as the linkage 13 moves, the hanging portion 14B of the thread hanging arm 14 is guided from the preparation position (FIG. 5) spaced from the hook 6A on the crochet needle 6 to a position adjacent and above the hook 6A (FIG. 7).

In the illustrated embodiment, although the thread hanging arm 14 is operated in the manner mentioned hereinabove by the operation of the cam 16 and connector rod 15, the guide arm 12 and thread hanging arm 14 may be integrally formed and the thread hanging arm 14 may be operated in the manner mentioned hereinabove only by the rotation of the guide arm 12 within the scope of the present invention.

Figure 5:
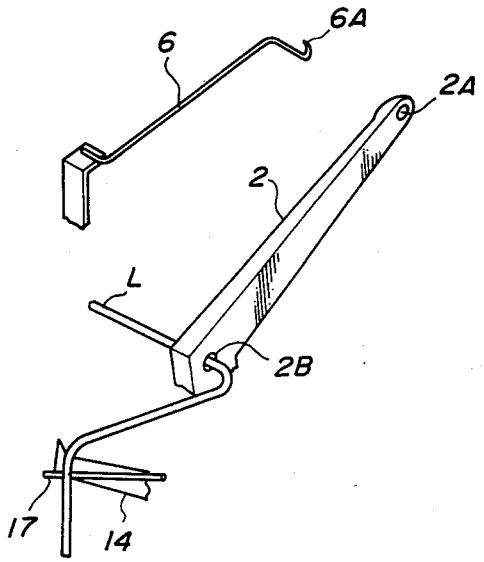
FIGS. 5 through 8 are views showing the successive stages of the operation of the threading device as shown in FIG. 1.
Figure 6:
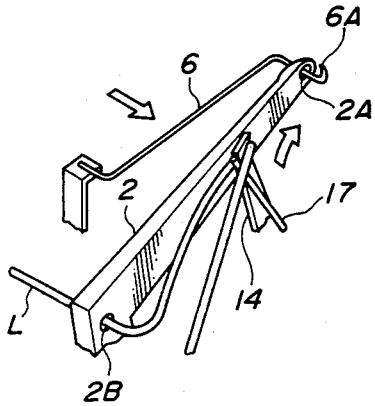

A thread handling member 17 is secured at the base end to the thread hanging arm 14 and normally positioned rearwardly from the cut in the thread hanging portion 14B of the thread hanging arm 14 by the elasticity provided by the thread handling member 17 itself (FIGS. 5 and 6). The thread handling member 17 is so disposed that when the thread hanging arm 14 is rotated about the pin 12A on the guide arm 12, the thread handling member 17 increases its contacting force against the pin 12A until the elasticity of the thread handling member 17 is overcome whereupon the thread handling member moves to a position forwardly from the thread hanging portion 14B across the hanging portion 14B.

Reference character S denotes a spring disposed between the thread hanging arm 14 and guide arm 12 and the spring normally urges the thread hanging arm 14 to its initial position.

Figure 2:
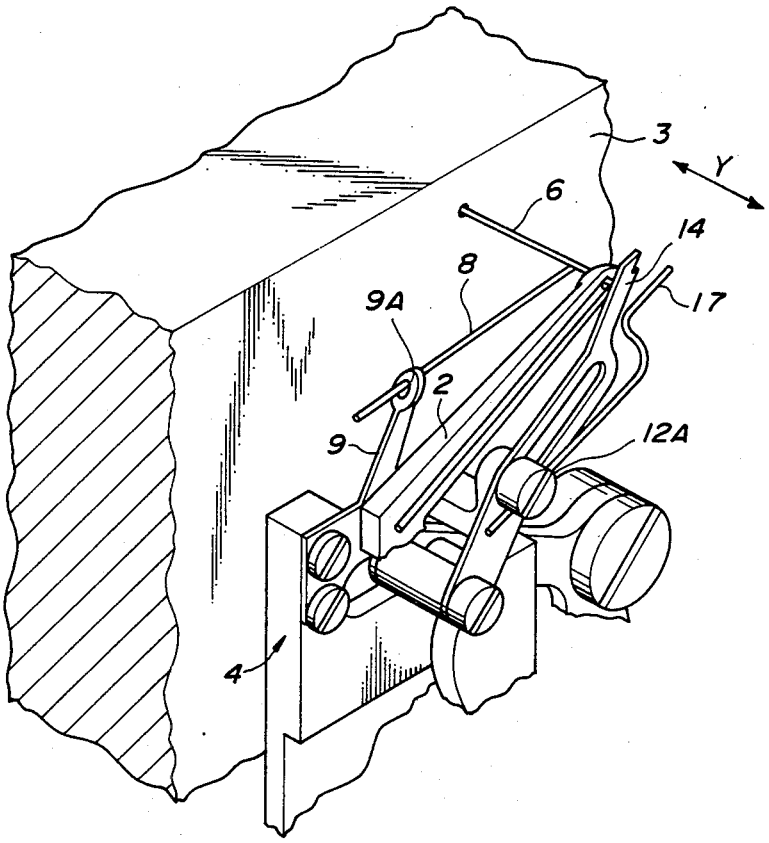
FIG. 2 is a fragmentary perspective view of a modified arrangement of the crochet needle for use in the threading device as shown in FIG. 1.

Reference numeral 18 in FIG. 1 denotes a tension device secured to the machine frame 3 and having a wire spring 18A wound thereabout and the looper thread L is passed through the first thread hole 2B in the looper 2 and the free end of the thread L is passed in contact with the wire spring 18A and then wound about the tension device 8 to be tensioned. A movable shearing blade 19 is secured at one or the lower end to the movable shaft 1 and moves to intersect the looper thread L positioned between the thread guide 21 and wire spring 18A and when the movable shaft 1 moves in its return stroke from the position of the movable shaft 1 as shown in FIG. 1, the movable shearing blade shears the leading end of the looper thread off the rest of the thread in cooperation with a stationary shearing blade 20 provided on the machine frame 3 in opposition to the movable shearing blade 19.

FIG. 3 shows the conditions of the operation lever 1 and the components associated with the lever when the thread hanging portion 14B of the thread hanging arm 14 is in its preparation position. In the conditions as shown in FIG. 3, the crochet needle 6 is spaced from the looper 2 as shown in FIG. 5.

After having passed through the first thread hole 2B in the looper 2 as shown in FIG. 5, the leading end of the looper thread L is hung over the thread hanging portion 14B of the thread hanging arm 14.

Thereafter, the leading end of the looper thread L is guided along the thread guide 21 and the wire spring 18A to the tension device 18 to be wound about the device 18 and the free end of the looper thread L is then pulled to bend the wire spring 18A whereby the looper thread is maintained in its tensioned condition. The looper thread L may be manually tensioned instead of being tensioned by the wire spring 18A.

Next, when the operation lever 11 is pulled from the position shown in FIGS. 4 and 5 in the arrow direction Y towards the viewer of FIG. 1, the movable shaft 1 and operation shaft 10 also move in the same direction. As the movable shaft 1 and operation shaft 10 move in the direction, the movable plate 4 also moves in the same direction and the movable shearing blade 19 pushed the leading end of the looper thread L upwardly and the cutting edge of the blade of the movable blade 19 faces the looper thread L.

As the movable shaft 1 and operation shaft 10 move in the above-mentioned direction towards the viewer of FIG. 1, the movable plate 4 and the crochet needle 6 secured thereto also move towards the thread hole 2A in the looper 2 to project the hook 6A on the needle 6 out of the second thrcad hole 2A in the looper 2 as shown in FIG. 6.

When the operation lever 11 is then rotated from the position by the solid line in FIG. 1 and the phantam line in FIG. 4 in the clockwise direction as shown in FIGS. 1 and 4, only the operation shaft 10 rotates in the clockwise direction as shown in FIGS. 1 and 4 to thereby move the linkage 13 leftwards as shown in FIG. 4. As the linkage 13 moves in the direction, the guide arm 12 also rotates in the clockwise direction and the cam 16 also moves leftwards.

As the cam 16 moves leftwards as seen in FIG. 4, the cam face 16A thereon contacts the pin 15A on the connector rod 15 to rotates the connector rod 15 in the clockwise direction as seen in FIG. 4. As the connector rod 15 rotates in the clockwise direction, the thread hanging arm 14 moves leftwards as seen in FIG. 4 while being guided by the pin 12A until the hanging portion 14B of the arm 14 reaches a position adjacent the second thread hole 2A in the looper 2. Accordingly, the pin 12A moves within the guide slot 14A from the upper end to the lower end of the slot to contact the thread handling member 17 so as to gradually move the member 17 against the elasticity of the member from a position behind the hanging portion 14B of the thread hanging arm 14 to a position in front of the arm whereby the looper thread L hung on the hanging portion 14B of the thread hanging arm 14 is dropped onto the crochet needle 6 which is now out of the thread hole 2A in the looper 2 as shown in FIG. 7.

Figure 8:
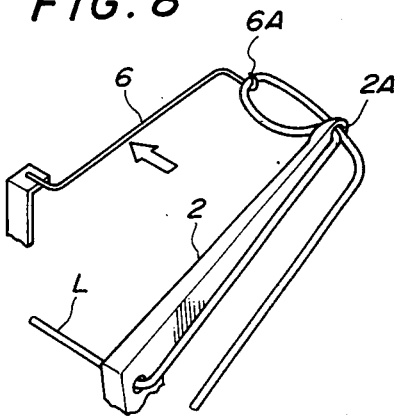

On the other hand, when the operation lever 11 is now rotated in the counter-clockwise direction to the initial position as seen in FIG. 1, the thread hanging arm 14 returns to the initial position leaving the looper thread L on the crochet needle 6 and at the same time, the movable plate 4 also returns to the initial position. As a result, the crochet needle 6 also returns to its initial position to have the hook 6A thereof pass through the thread hole 2A in the looper 2 whereby the looper thread L is passed through the thread hole 2A as shown in FIG. 8. As the operation lever 11 is rotated in the counter-clockwise direction, the movable blade 19 moves to contact the stationary balde 20 so as to shear the leading end of the looper thread L positioned between the wire spring 18A and thread guide 21. In this manner, when the looper thread L has been once inserted into the thread hole 2A in the looper 2, the thread leading end is pulled out of the thread hole 2A by a pincette, for example, whereby the looper thread L can be completely passed through the thread hole 2A.

FIGS. 9 through 18 show the second embodiment of the threading device of the present invention.

In FIGS. 13, 14, 16, 17 and 18, reference numeral 31 denotes the looper supported on the machine frame 30 below the throat plate (not shown) and the looper is adapted to rock between a first position (the chain - dot line position) and a second position (the solid line position) in response to the rotation of the main shaft (not shown) of the sewing machine and has a first thread hole 32 at the base end and a second thread hole 33 at the leading end.

A thread holding-down member 34 is mounted on the machine frame 30 spaced from the inner side **31*b* of the looper 31 and adapted to hold down the leading end La of the looper thread L which has been supplied from the supply source and passed through the first thread hole 32 in the looper 31 from the outer side 31*a* to the inner side 31*b* of the looper 31**.

As more clearly shown in FIGS. 9 through 12, the thread hanging member 35 is mounted on the machine frame 30 and comprises a cylindrical portion 36 rotatably supported on the machine frame, a first hanging arm portion 38 secured to the cylindrical portion at right angles thereto and having an elongated slot 37 and a second hanging arm portion 44 having a pin 39 received in the slot 37 at the base end, a hook portion 40 at the leading end and an elongated slot 43 for receiving pins 41, 42 on the machine frame 30.

$S_1$ denotes a spring interposed between the second hanging arm portion 44 and the machine frame 30 and normally urging the second hanging arm portion 44 away from the looper 31.

Figure 9:
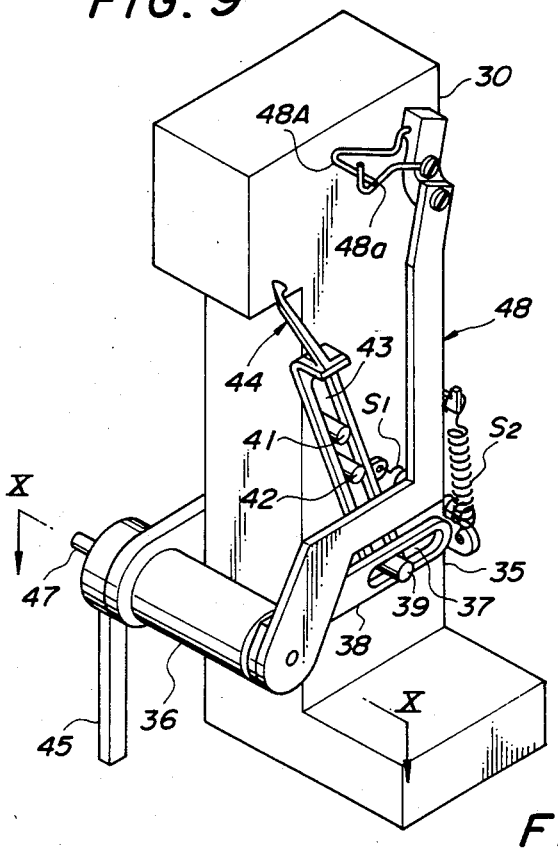

In operation, when the operation lever 45 secured to the cylindrical portion 36 of the thread hanging member 35 is rotated in the counter-clockwise direction as seen in FIG. 9, the first hanging arm 38 also rotates in the same direction whereby the second hanging arm portion 44 is guided by the pins 41, 42 to move from a position spaced from the looper 31 to a position in which the looper thread L (of which description will be made later) which has emerged from the second thread hole 33 at the leading end of the looper 31 is moved to and hung over the second hanging arm 44.

Figure 10:
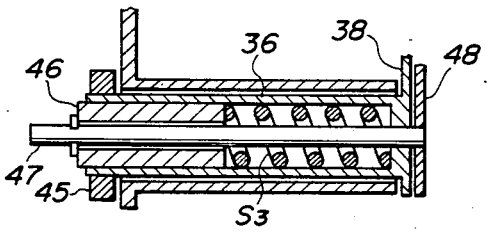
Figure 11:
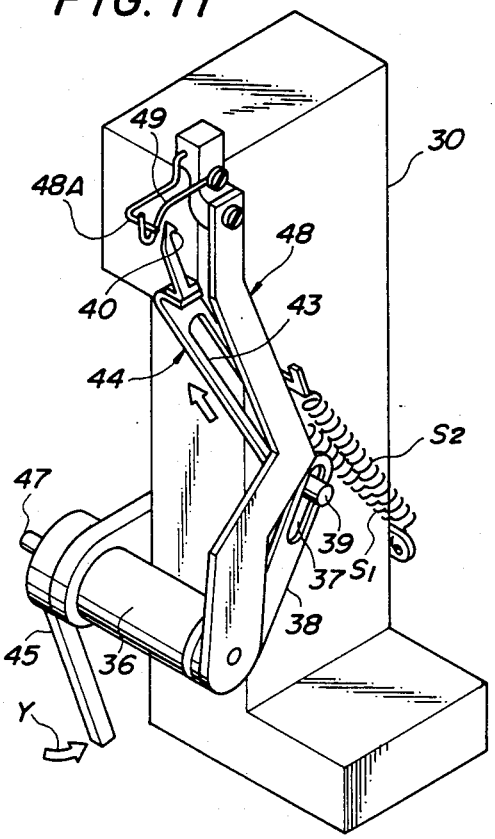

A hollow cylindrical support 46 is freely received within the cylindrical portion 43 and normally urged leftwards as seen in FIG. 10 under the force of a spring $S_3$ received within the cylindrical portion 36.

A movable shaft 47 is fitted in one end portion within the support 46 in parallel to the axis of rocking (not shown) of the looper 31 and has an L-shaped rotary arm 48 secured to the other end.

Figure 15:
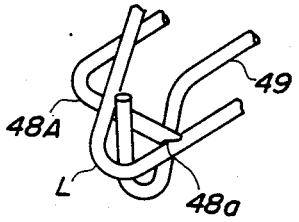
Figure 17:
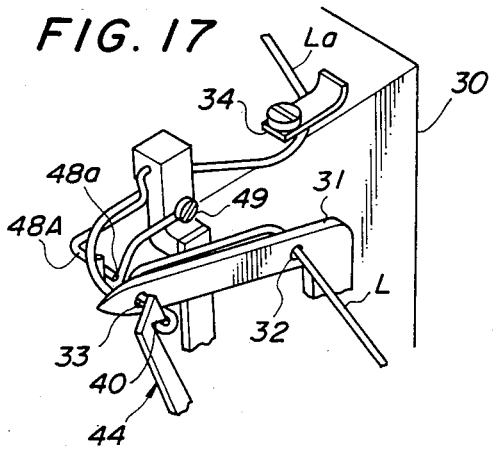

An L-shaped threader rod or means 48A is secured to the above-mentioned rotary arm 48 and has one arm extending in parallel to the axis of the second thread hole 33 in the looper 31 and having the thickness smaller than the size of the hole 33. The threader means 48A further has a hook **48*a* at the leading end for hanging the looper thread L thereover (FIG. 15**).

The rotary arm 48 is normally urged leftwards or against the second hanging arm under the force of the spring $S_3$ which also urges the support 46 leftwards as seen in FIG. 10 and movable along the axis of rocking of the rotary arm 48 or the axis of the movable shaft 47 when the movable shaft 47 is moved against the force of the spring $S_3$.

Furthermore, the rotary arm 48 is urged to contact the pin 39 on the second arm 44 by the force of a spring $S_2$ interposed and acting between the arm 48 and machine frame 30. In response to the rotation of the lever 45, the first arm 38 and the second arm 44 move whereby the rotary arm 48 rotates from the position in which the hook **48*a* at the leading end of the threader rod or means 48A is spaced from the inner side 31*b* of the looper 31 (FIG. 13) through the path between the first thread hole 32 in the looper 31 and the holding-down member 34 where the looper thread L is hung over the hook 48*a* to the position in which the hook 48*a* is positioned in an extension line of the axis of the second thread hole 33 in the looper 31**.

A resilient thread transfer member 49 is provided and has the leading end positioned at the leading end of the threader rod or means 48A and the base end secured to the leading end of the rotary arm 48. The resilient thread transfer member 49 is so designed that before the threader rod 48A advances into the second thread hole 33 in the looper 31, the free end of the thread transfer member 49 contacts the inner side **31*b* of the looper 31 and as the threader rod 48A then advances into the second thread hole 33, the member 49 moves to the base end of the threader rod 48A against the elasticity of the member 49** itself.

Figure 13:
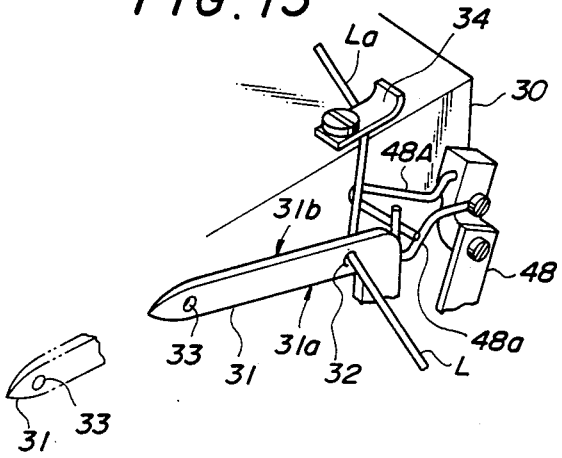

The operation of the second embodiment will be now described. FIG. 13 shows the looper 31 in the second position in which the threader rod 48A and the hook 40 of the thread hanging member 35 (not shown) are spaced from the looper 31.

In the position of the looper 31 shown in FIG. 13, the leading end of the looper thread L from the supply source is passed through the first thread hole 32 in the looper 31 and under the holding-down member 34 to be held down by the holding-down member.

Figure 14:
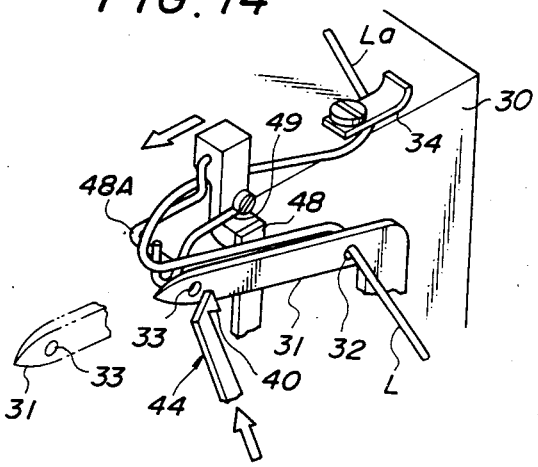

Next, the operation lever 45 is rotated in the arrow direction Y whereby the first hanging arm 38 is first rotated in the counter-clockwise direction to position the hook 40 on the second hanging arm 44 in a position adjacent the second thread hole 33 in the looper 31 as shown in FIG. 14. The movement of the second hanging arm portion 44 rotates the rotary arm 48 in the counter-clockwise direction by the pin 39 on the second arm 44 to position the hook 48*a* at the leading end of the threader rod 48A in an extension line of the axis of the second hole 33 (FIG. 14) having the length of the looper thread L extending between the holding-down member 34 and the first hole 32 in the looper 31 hung thereon (FIG. 15).

Figure 12:
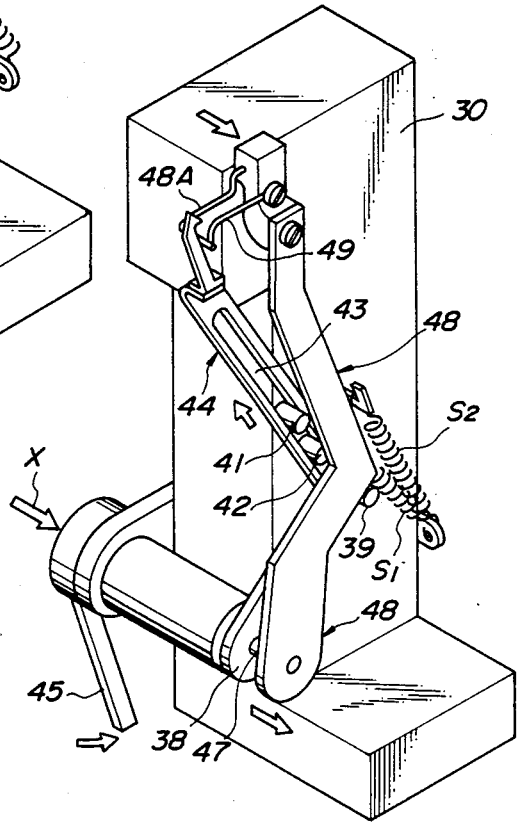
Figure 16:
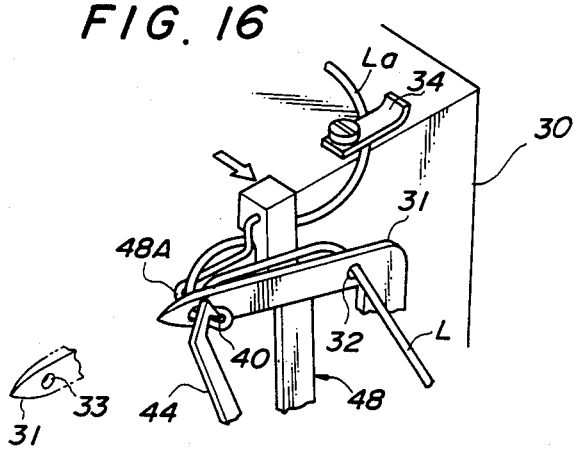

Thereafter, when the leading end of the movable shaft 47 is pushed against the force of the spring $S_3$ in the arrow direction X as shown in FIG. 12, only the rotary arm 48 moves in the arrow direction X and thus, the hook 48*a* on the threader rod 48A advances into the second thread hole 33 in the looper 31 carrying the looper thread L therewith (FIG. 16).

When the force applied to the movable shaft 47 is removed therefrom, the spring $S_3$ extends to return the rotary arm 48 to the initial position and the hook 48*a* on the threader rod 48A withdraws from the second thread hole 33. As the hook 48*a* withdraws from the second thread hole 33, the looper thread L also tends to withdraw from the second thread hole 33, but since the length of the looper thread L adjacent the opening of the second thread hole 33 is pressed against the inner side 31*b* of the looper 31 by the resilient member 49 until the threader rod 48A has withdrawn completely from the first thread hole 32, the looper thread L is left extending in a looped condition on the outer side 31*a* of the looper 31 and thus prevented from withdrawing from the thread holes 32, 33.

Figure 18:
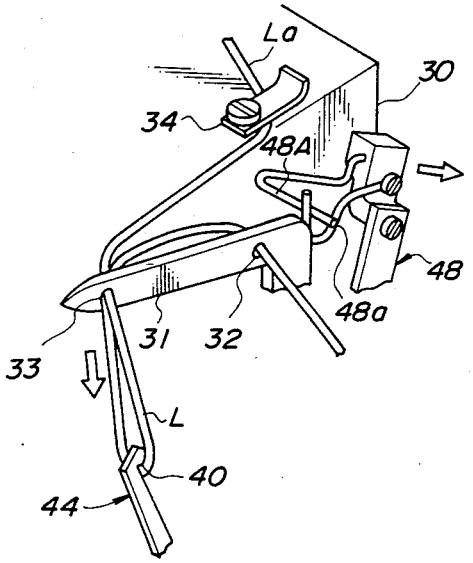

Next, when the force for rotating the lever 45 is released from the lever, the first and second hanging arms 38, 44 return to the initial position under the force of the spring $S_1$. At this time, the second hanging arm 44 moves downwardly as shown in FIG. 18 and the hook 40 hangs the looper thread length projecting from the looper 31 in the looped condition thereover and pulls the thread L out of the second thread hole 33.

In this way, the leading end of the looper thread L is passed through the second thread hole 33 and pulled out of the hole to form the loop projecting from the outer side 31*a* of the looper 31 to a position in which the operator can easily insert his finger into the loop.

Thereafter, after the looped length of the looper thread L has been manually pulled to withdraw the leading end of the thread L from the second thread hole 33, the leading end of the thread is then passed through the first thread hole 32.

In the first and second embodiments described hereinabove, in response to the rotation of the manual lever 11 or 45, the thread hanging arm 14 or resilient member 49 as the thread transfer means is rotated to move the leading end of the looper thread L which has passed through the first thread hole 32 in the looper 31 to one side of the second thread hole 33 and the crochet needle 6 or threader rod 48A is then moved to pull or push the thread leading end out of the other side of the looper. However, in a further embodiment of the invention, the thread transfer means and threader means can be moved by separate levers or controlled simultaneously or separately by an automatic electromagnetic device.

In a further embodiment of the present invention, the thread transfer means may a linear thread transfer means or the looper thread L may be moved to one side of the opening of the second thread hole by an air nozzle.

Furthermore, the threader means may be replaced by an air nozzle which spouts an air flow under pressure to pass the looper thread from one side to the other side of the second thread hole.

With the above-mentioned construction and arrangement of the components of the threading device for the looper in a sewing machine according to the present invention, in a hem-stitch sewing machine installed in a very limited space where the feed mechanism, cloth cutting machine and the like are positioned, the leading end of the looper thread can be quite easily passed through the thread holes in the looper even by an unskilled worker and thus, operational efficiency on the sewing machine is enhanced.

While the invention has been particularly shown and described with reference to the preferred embodiments thereof, it will be understood by those skilled in the art that various changes in form and details may be made therein without departing from the spirit of the invention.

We claim:

1. A threading device for the looper in a sewing machine, said looper being supported on the frame of said sewing machine for rocking movement and having first and second thread holes opening at right angles to the longitudinal direction of said looper comprising:

a hollow movable shaft supported on said frame of the sewing machine for movement in opposite directions at right angles to the longitudinal direction of the looper;

a movable plate secured to said movable shaft for movement together with the shaft;

a crochet needle secured to said movable plate and having an upwardly bent hook at one end;

an operation shaft rotatably received within said movable shaft for rotation about the axis of the movable shaft;

an operation lever connected to said operation shaft to rotate the operation shaft;

a guide arm rotatably supported on said movable plate by a first pin and having a second pin at one end;

a linkage connecting between said operation shaft and guide arm to rotate the guide arm about the axis of said first pin;

a rockable thread hanging arm having a slot for receiving said second pin on the guide arm and a thread hanging portion at one end, said thread hanging portion being formed with a cut;

a connector rod rockably supported on said guide arm and connecting between said guide arm and thread hanging arm, said connector rod having a third pin;

a cam secured to said linkage and having a cam face adapted to contact to said third pin on the connector rod to rotate the connector rod so as to move said thread hanging portion of the thread hanging arm from a position spaced from said hook of the crochet needle to a position adjacent and about the hook of the crochet needle in response to the rotation of said operation shaft;

a resilient thread handling member secured to said thread hanging arm, said thread handling member being normally positioned rearwardly from said cut in the thread hanging portion of the thread hanging arm by the elasticity of the member and movable to a position in front of said thread hanging portion against the elasticity of the member in response to the rotation of said thread hanging arm about said second pin on the guide arm; and a spring interposed between said guide arm and thread hanging arm to normally urge the thread hanging arm to the initial position.

2. The threading device for the looper in a sewing machine as set forth in claim 1, in which said crochet needle is secured at the other end to said movable plate and so arranged that when said movable shaft moves in one direction the hook of the needle advances into said second thread hole in the looper and when the movable shaft moves in the other direction the hook withdraws from the second thread hole.

* * * * *